United States Patent [19]

Gotberg

[11] 4,344,661

[45] Aug. 17, 1982

[54] DRAWER ASSOCIATING CONSTRUCTIONS

[76] Inventor: John P. Gotberg, Box 551, Franklin, Mich. 48025

[21] Appl. No.: 115,246

[22] Filed: Jan. 21, 1980

Related U.S. Application Data

[63] Continuation-in-part of Ser. No. 949,076, Oct. 6, 1978.

[51] Int. Cl.[3] ..... A47B 47/00; F16B 12/00

[52] U.S. Cl. ..... 312/330 R; 312/184; 312/111; 211/194; 232/44

[58] Field of Search ..... 312/330 R, 111, 184; 211/194; 108/91; 232/44

[56] References Cited

U.S. PATENT DOCUMENTS

| | | | |
|---|---|---|---|
| 1,240,851 | 9/1917 | Hunter | 312/111 |
| 1,370,167 | 3/1921 | Thompson | 232/44 |
| 3,112,967 | 12/1963 | Hood | 312/184 |
| 3,606,023 | 9/1971 | Edmunds | 211/194 |
| 3,729,242 | 4/1973 | Barney | 312/111 |
| 3,945,497 | 3/1976 | Greenberg | 211/194 |
| 3,974,898 | 8/1976 | Tullis et al. | 312/111 |
| 4,077,685 | 3/1978 | Scire et al. | 312/330 R |
| 4,108,520 | 8/1978 | Litchfield | 312/111 |
| 4,184,599 | 1/1980 | Drake et al. | 211/194 |
| 4,196,948 | 4/1980 | Gavel et al. | 312/111 |

*Primary Examiner*—Victor N. Sakran

*Attorney, Agent, or Firm*—Cushman, Darby & Cushman

[57] ABSTRACT

In a stack of two or more drawers, the upper drawer has a removable bottom and several ways are shown for selectively ganging the drawers together. Thus, each two drawers vertically adjacent one another in the stack may be used separately, or the bottom may be removed from the or each relatively upper drawer and the respective drawers ganged together to effectively exchangeably provide a larger number of shallower drawers or a lesser number of deeper drawers.

16 Claims, 14 Drawing Figures

Fig. 12
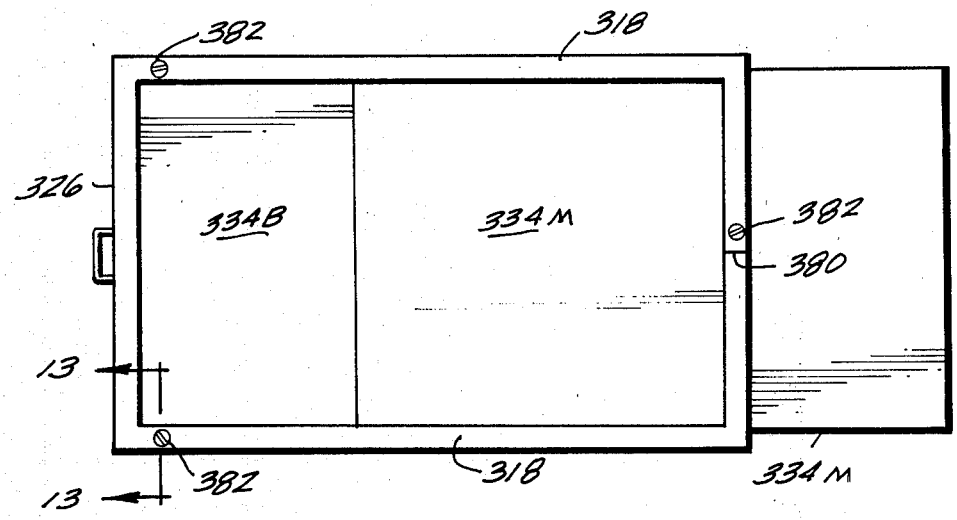
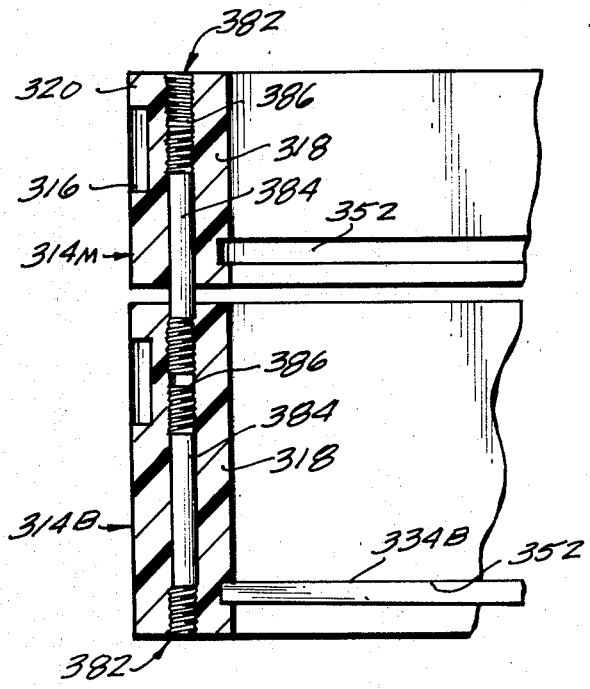
Fig. 13
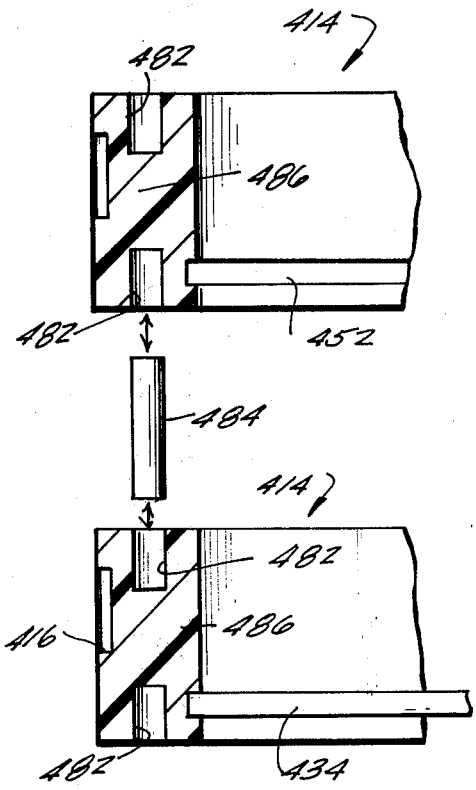
Fig. 14

DRAWER ASSOCIATING CONSTRUCTIONS

REFERENCE TO RELATED APPLICATION

This is a continuation-in-part of my copending U.S. patent application, Ser. No. 949,076 filed Oct. 6, 1978.

BACKGROUND OF THE INVENTION

Office desk 10, pedestals 12 and filing cabinets, whether made of sheet steel (as is more common), wood, or the like often include, as is illustrated in FIG. 1, a tier of several individual drawers 14 of like downwardly increasing depths. In this widely used construction, the drawers 14 each have roller tracks 16 running along the side walls 18, via which the drawers are individually hung between opposed interior side walls 20 of the pedestal 12 or case so that each may be individually slid out and in.

An often encountered problem is the need for the user of an office desk or filing cabinet to store something in it that is much too deep for its drawers. An example is the need for a user to file vertically in the desk pedestal or filing cabinet sheets 22 of electronic data processing print-out paper, as sheets or bound, (hereinafter called "E.D.P. print-out paper"). As can be seen from FIG. 1, the E.D.P. print-out paper 22, when turned on one side edge would fit in a single drawer 14 widthwise of the drawer, but would be far too tall to fit.

SUMMARY OF THE INVENTION

In my aforesaid parent patent application, there is described an invention which seeks to solve the above problem by giving one or more of the upper drawers hinged "trap door" bottom which can be selectively lowered when desired, thus ganging the respective upper and lower drawer or drawers together and effectively creating correspondingly less individual drawers of correspondingly greater depth.

One or more upper hung drawers in a single tier as in a file cabinet or desk pedestal each is provided with a floor that is split in two along its length from front to back and hinged along its side edges. A retainer when in place keeps this floor up and functional. When the retainer is removed, the floor sections rotate down along their respective hinge joints and hang into the next lower drawer flat against its side walls. This gangs the two drawers together effectively as one, deeper drawer. Two, three or more drawers may be ganged together in this manner. In one variation, the floor is split in two along its width from side to side and each part is subdivided into hinged plates.

Upon giving the matter more thought I have devised additional ways and means for selectively ganging drawers together, in which the upper drawer bottoms are slid out or otherwise completely removed, and in which the structure which selectively gangs the drawers together is not necessarily part of what otherwise serves as a drawer floor but may be particularly provided for this purpose.

In practicing the present invention in its presently most preferred form, in a stack of two or more drawers, the upper drawer has a removable bottom and several ways are shown for selectively ganging the drawers together. Thus, each two drawers vertically adjacent one another in the stack may be used separately, or the bottom may be removed from the, or each relatively upper drawer, and the respective drawers ganged together to effectively exchangeably provide a larger number of shallower drawers or a lesser number of deeper drawers.

The invention may be employed both for retrofitting existing filing drawers and for the constructions or new desks and filing cabinets.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIG. 1 is a fragmentary perspective view of a desk having a three drawer filing cabinet as one pedestal thereof, a sheet of E.D.P. paper stock being ranked beside the pedestal to illustrate a problem often encountered. The middle drawer is shown pulled out part way to expose some conventional details being referred to.

FIG. 12 is a top plan view of a stack of drawers provided with another preferred embodiment of the structure of the present invention; and FIG. 13 is a fragmentary sectional view taken on line 13—13 of FIG. 12.

FIG. 14 is a sectional view similar to part of FIG. 12, of a further preferred embodiment.

DETAILED DESCRIPTION OF THE EMBODIMENTS SHOWN IN FIGS. 1-9

Figure 1:
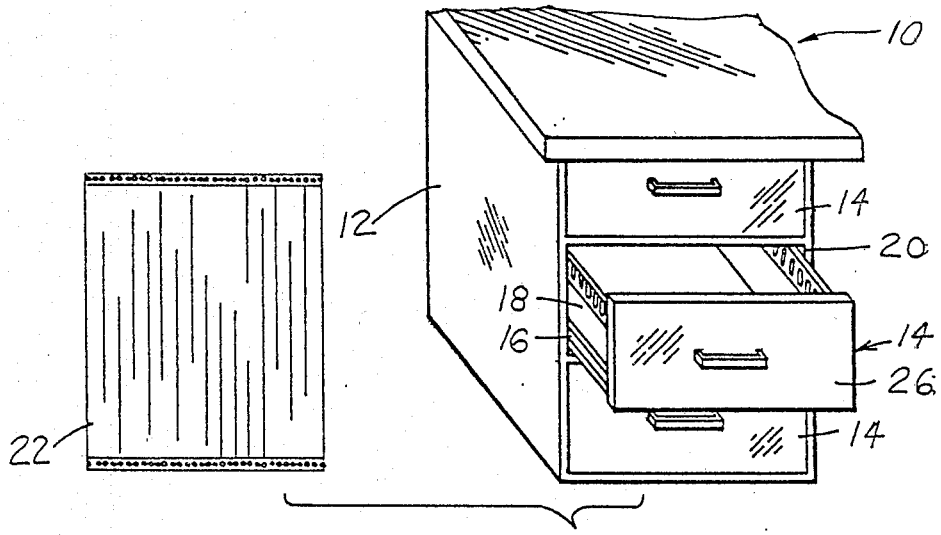

(A description will be made relative to one upper individual drawer 14 and its respectively next lower neighboring drawer 14. The same principles apply to that next lower drawer and its respectively next lower neighboring drawer 14 for as many drawers as are equipped using the principles of the invention, i.e. for ganging together 2, 3 or more individual drawers.)

(In the office furniture trade, a relatively shallow drawer is known as a "box" drawer and a somewhat deeper drawer is called a "file" or "letter" drawer. An even deeper drawer may be known as an "EDP" drawer. So far as office furniture is concerned, the principles of the invention may be employed on any and all of such drawers in all possible combinations. Further it is true that some drawers are shorter front-to-back than they are wide side-to-side, other drawers are about equal in these dimensions and in still others, the situation is reversed. References to particular sorts of drawers, i.e. office furniture filing cabinet drawers that are longer than wide, in the following description are for convenience in illustration. Of course, the invention is applicable to drawers made of any material used to manufacture drawers; wood, plastic, rubber, steel and aluminum being non-limiting examples.)

A typical drawer 14 includes two opposed upstanding side walls 18, each with a mounting means, e.g. a roller track provided on the outside thereof. In addition, the drawer 14 typically includes a rear wall 24 which is about as tall as the side walls 18, and a front 26. Typically, the front 26 is of hollow, double wall construction so as to provide both a front wall 28 for the drawer interior and a drawer front 30 for the pedestal or case in which the drawer 14 is received. Typically, a drawer pull 32 is provided on the outside of the drawer front, and the front 26 is both taller and somewhat wider than the transverse vertical cross-sectional figure of the individual drawer proper extending back of the drawer front.

Now to what is different.

In place of the usual drawer bottom, each of one or more of the upper drawers 14 is provided with a "trap door" floor 34 and removable retainer means 36 for releasably supporting the floor 34 in a normal, "up" position.

Figure 5:
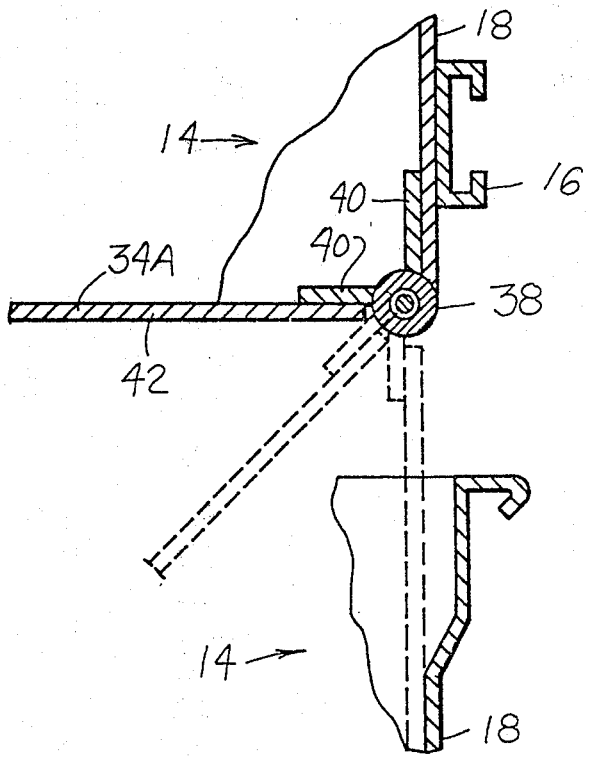
FIG. 5 is a larger scale vertical transverse cross-sectional view illustrating how that drawer becomes associated with the one below it as the upper drawer's floor is collapsed about the side hinges.

By preference, the floor 34 is provided in two side-by-side halves 34A, 34B each of which is hinged at 38 along the base of a respective side wall 18. As shows best in FIG. 5, preferably each hinge 38 is a so-called piano hinge which extends from the front to the back of the respective floor half and side wall. The hinge plates 40, in the case of metal drawers, are tack welded on the inside of the side walls and floor, i.e. on the upper surface of the floor bordering its side edges, so that when the floor sections are released to hang down their outer, formerly lower surfaces 42 come to rest against the inner surfaces of the side walls of the respectively next lower drawer so that substantially all of the inner space of the combined drawers remains useful.

A preferred means 36 for retaining the drawer trap door bottom in a raised, useful-as-a-bottom condition is shown being constituted by a removable strap 44 and means for removably mounting the strap 44 in place.

As shown the strap 44 is made of sheet or plate steel to include an elongated, flat, horizontal main portion 46, typically three inches wide, a rear wall hooking flange 48 and a front wall hooking flange 50. The main portion 46 is a long front-to-rear as is the drawer bottom. The rear wall hooking flange 48 is formed by bending the strap up along a transverse line 52, then doubling outward and downwards along a transverse line 54 a short portion 56. The front wall hooking flange 50 is similarly formed so as to have a tang 58.

If necessary, the drawer bottom 34 may be notched or gapped from the drawer front and drawer back at least in the vicinity of its longitudinal centerline, in order to accommodate assembly of the strap 44 therewith.

Preferably, the inner wall 28 of the drawer front 26 is centrally provided midway up its height with a horizontal, laterally extending slot 60.

For normal use as an individual drawer, the drawer bottom sections 34A, 34B are folded up along the hinges 38 and the strap 44 is installed by inserting its front wall hooking flange 50 tang 58 in the slot 60, and catching the rear wall hooking flange 48 on the upper edge 62 of the drawer rear wall along the centerline of the drawer. Then the two drawer bottom sections 34A, 34B are folded flat so that their centrally located edge regions 64 come to rest upon the strap 44 main portion 56.

When so assembled, each drawer 14 may be used as an individual drawer, for as long as desired, even for many years. Whenever, and for however long it is desired to gang two or more individual drawers 14 together to create effectively less individual drawers but one or more deeper ones, the respective strap or straps 44 are removed by reversing the above procedure, and the respective drawer bottom sections 34A, 34B are permitted to pivot downwards (see the dashed lines in FIG. 5). Because the bottom sections 34A, 34B are substantially as long as the drawer interiors, and, when lowered each such section of an upper drawer depends far enough downwards to be caught between the front and rear walls of the next lower drawer 14, a single composite has been made of the plurality of drawers. Pulling on one hand 32 will pull out the whole composite, so that if the individual drawers were two box drawers, a file drawer has been created. If a file drawer has been effectively deepened by ganging another drawer thereto by dropping the "trap-door" bottom of the upper one of them, such a deep composite drawer may be created that tall items, such as E.D.P. print-out paper may be stored therein and retrieved therefrom.

Should there come a time when such drawer depth is no longer needed, the individual drawers 14 may be restored to their original separate status by reinstalling the strap or straps 44 according to the above procedure.

Figure 6:
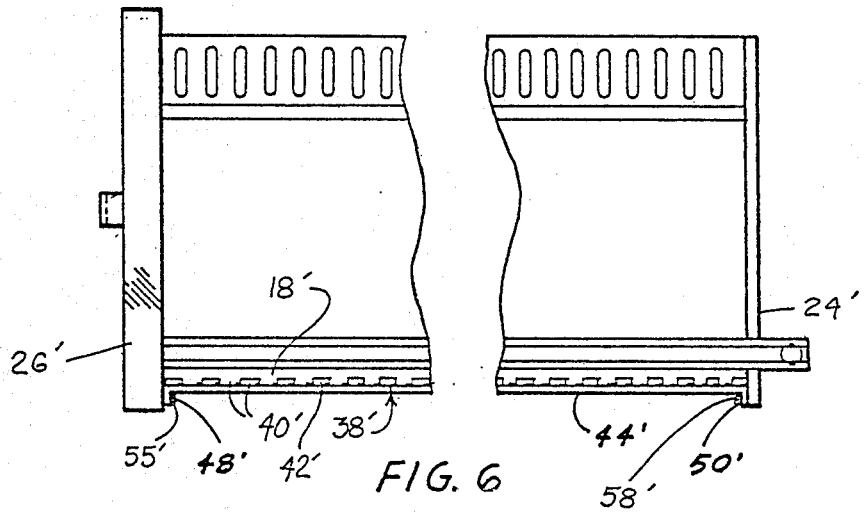
FIG. 6 is a side elevation view of another version of the drawer, illustrating some individually alternatively useful features, with the drawer bottom being somewhat differently hinged and the support bar having another form of removable securement to the drawer.

FIG. 6 is provided so that two alternative features independently usable on any of the embodiments shown can be described.

First, note that as shown in FIG. 6, the piano hinges 38' are eliminated as separate elements by making their hinge plates 40' integral with the respective side walls 18' and drawer bottom 42' at the side margins of the bottom.

Second, note that the way the floor halves are kept up in their horizontal, supporting condition is somewhat different. In particular, the retainer 44' is releasably mounted entirely under the drawer bottom by having down-turned tang portions 48', 50' at its respective ends, respectively releasably secured, e.g. by screws, bolts or similar fasteners 55', 58' secured to the front 26' and rear 24'. The screws or the like are installed or engaged to hold the retainer in place and are removed or released to permit removal or release of the retainer. The retainer need not be fully physically separable from all of the drawer. For instance, when released, it could remain secured to one of the floor sections 34A, 34B.

Figure 7:
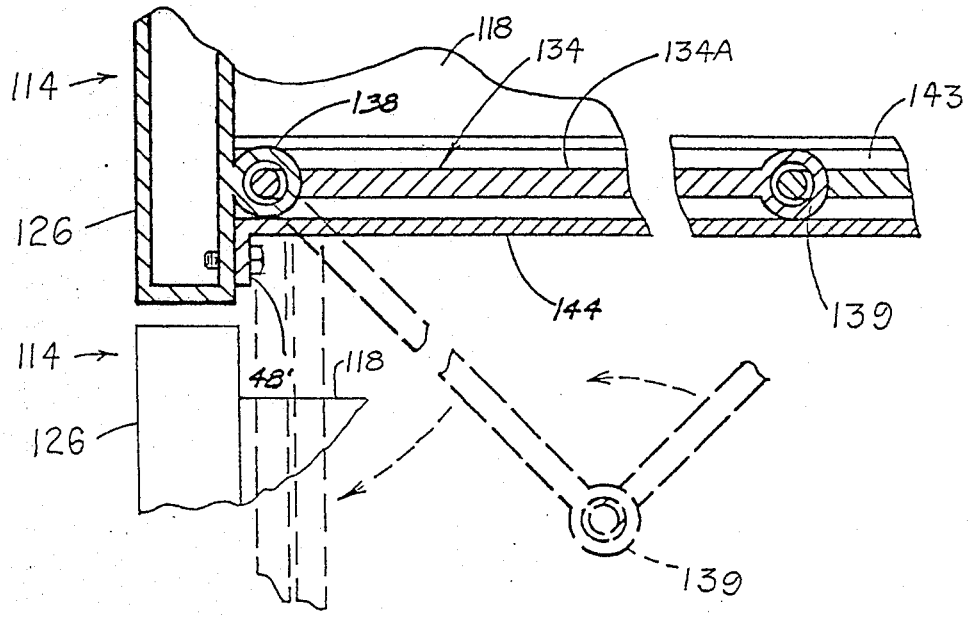
FIG. 7 is a fragmentary transverse vertical sectional view, similar to the full line upper portion of FIG. 5, but of the embodiment shown in FIG. 8.
Figure 8:
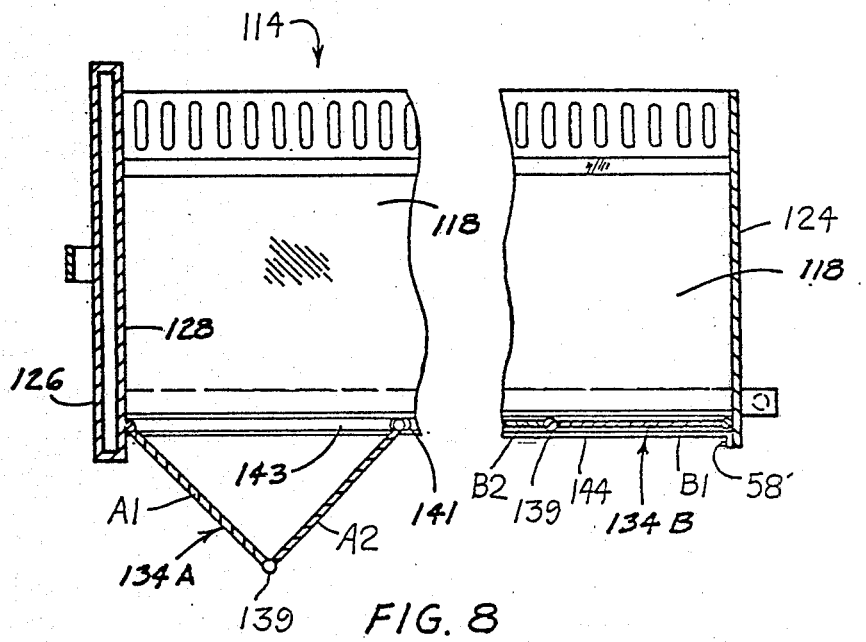
FIG. 8 is a longitudinal vertical sectional view of the FIG. 7 embodiment, wherein the hinged "trapdoor" drawer bottom is split transversally, each half is also hinged along transverse hinge lines intermediate its length and the resulting drawer bottom plates are guided in roller tracks, in this view the front half (at the left in the Figure) being shown partially collapsed and the rear half (at the right in the Figure) being shown fully up in horizontal, supporting condition.
Figure 9:
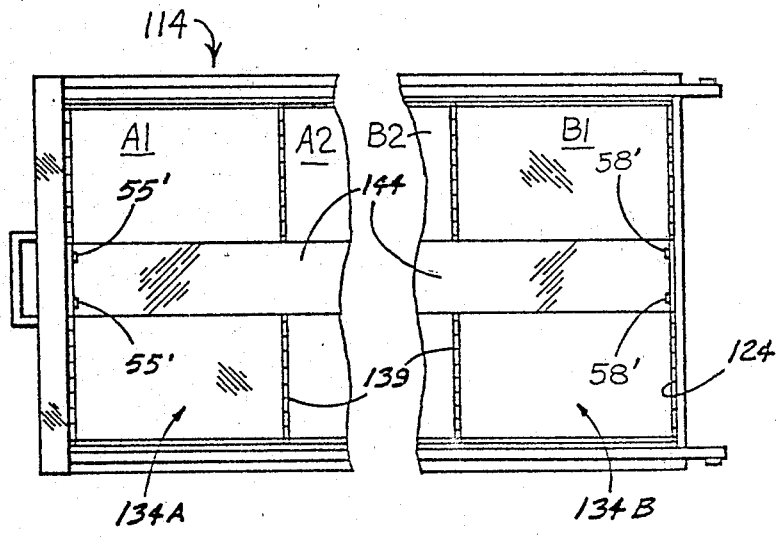
FIG. 9 is a bottom plan view of the drawer shown in FIG. 8, with both halves of the drawer being fully up in supporting condition and the support strap being shown secured in place.

Another independently useful alternative feature is illustrated in FIGS. 7, 8 and 9.

In FIGS. 7, 8 and 9 the drawer bottom 134 is split transversally intermediate the length of the drawer 114 into two sections 134A, 134B. The front edge of the front section 134A is hinged to the back 128 of the drawer front 126 (and/or to the two side walls 118). The rear edge of the rear section 134B is hinged to the front of the drawer back 124 (and/or to the two side walls 118).

By preference, the sections 134A, 134B are further sub-divided by intermediate hinges 139 extending transversally thereof intermediate the lengths thereof, into pivotally longitudinally adjoining plates A1, A2 and B1, B2.

The rear edge of the front section 134A and the front edge of the rear section 134B are, at their respective side margins, shown provided with respective glides or rollers 141, which are guidingly received in respective tracks 143 provided on the inner faces of the drawer side walls 118.

Normally, the four plates A1–B2 are horizontally disposed in generally the same plane and a retainer 144 is in place holding them there. (In the instance illustrated, the retainer 144 is substantially identical to the retainer 44' shown in FIGS. 6 and 7 and is removably installed the same way, as shown in FIG. 9.)

With the embodiment of FIGS. 8 and 9, when it is desired to gang two vertically adjoining drawers together, the "trap-door" floor of the relatively upper one of them is collapsed, accordian door-style, by releasing the retainer 144 (and removing it if it is designed to be removed). Then the two sections 134A, 134B may be respectively buckled downwards along their hinges 139. This causes the rear edge of the front section 134A to come to rest adjacent the front edge of the front section, and the front edge of the rear section 134B to come to rest near the rear edge of the rear section. In these latter positions, the now-lowermost region of each doubled-over section depends into adjacency with the inner face of the respective drawer front and drawer back. The net effect is much as depicted in and as described with respect to FIG. 5. Either the various hinges may be so constricted as to ensure that so long as the floor plates are collapsed the drawers are ganged together, or means (not illustrated) may be provided for securing the collapsed floor plates of the upper drawer to the front and/or rear walls and/or to the side walls of the associated relatively lower drawer.

Although the invention has been described in the context of office equipment, e.g. desk pedestals and filing cabinets, the principles of the invention may be put to work anywhere there are two or more vertically superimposed drawer or drawer-like members in a frame or case member. For instance the invention may be put to use in the fields of kitchen and food service cabinetry for homes, airlines and institutions; lab, hospital and medical care cabinetry; industrial materials handling and storage units; library and educational cabinetry; and home storage and workshop cabinetry and the like.

Although the invention has been described so far as if the basic unit were a single drawer with a releasable retainer for its split, hinged "trap-door" bottom, or two or more drawers stacked in a frame or case wherein each or at least one relatively upper drawer is provided with a releasable retainer for its split, hinged "trap-door" bottom, another merchandizing and use concept should now be apparent. That is, the principles of the invention permit a manufacturer or retailer to make or stock one design of desk pedestal, filing cabinet or the like and to furnish it variously equipped to suit the needs of the customer. For instance, someone who wanted all shallow drawers could be sold the pedestal with all retainers in place so that each drawer functioned as an individual. Someone else who wanted one or more deep drawers could be sold the same desk pedestal or the like but with two or more of the individual drawers already ganged together. The latter customer thus might never see a retainer 44, 44' or 144, or even be aware of the existence thereof. Further, in such an instance retainers could be sold as optional extras for use when desired. In that broad sense and in such instances, the retainer need not be considered a fundamental or essential element of the invention. In any of the disclosed versions, there are instances where the floor may be constituted by only one hinged section, whether or not that section is also intermediately hinged.

Detailed Description of the Embodiments Shown in FIGS. 10–14

Figure 10:
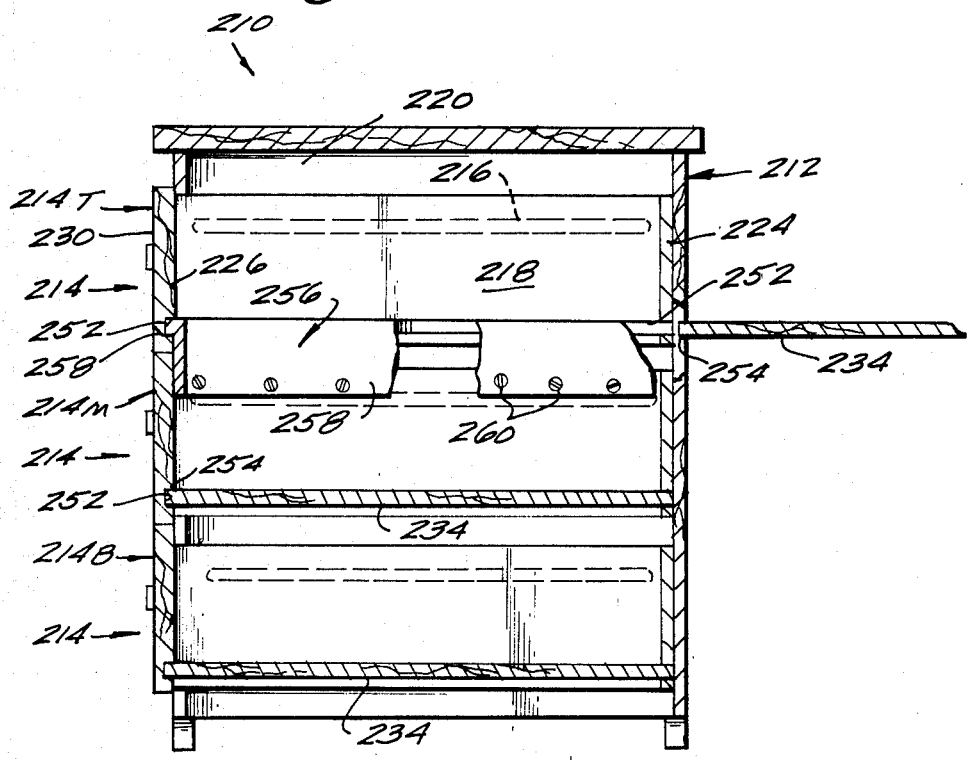
FIG. 10 is a vertical sectional view of a desk pedestal showing a stack of three drawers, the top one of which has had its drawer bottom removed and the top two of which are ganged in association by a strap provided in accordance with a presently preferred embodiment of the invention.

In FIG. 10 there is shown a desk 210, having a pedestal 212 in which a tier of a plurality, e.g. three drawers 214 are slidably received. Each drawer 214 is individually hangingly supported for being pulled-out and pushed-in, via roller tracks, side glides or the like 216 which are mounted on and extend between each side wall 218 of each drawer and the interior of the respectively adjoining side walls 220 of the pedestal 212.

Each drawer 214 also typically includes a back or rear wall 224 which is about as tall as the side walls 218 and a front wall 226.

Typically the desk case and drawers of FIG. 10 are made of wood and the exteriors 230 of the lower front walls 226 serve as part of the front of the case in which the drawers are received.

At least each of the relatively upper drawers 214 is provided, in this preferred embodiment, with a drawer bottom 234 that is completely removable. For instance, the drawer front 226 and both sides 220, near their lower edge 250 are provided with a groove, i.e. a rabbet 252 which slidingly receives the corresponding marginal side and front edge portions 254 of the drawer bottom 234.

The drawer bottoms 234 may be constructed and fitted so as to tend to remain in place merely due to a frictional fit at 252, 254, or may be held in place by an conveniently releasable securement means (not shown), such as wood screws.

In FIG. 10 the bottom of the top drawer has been slid out and the top and middle upper drawers are shown connected to one another in a manner to be further described below. The bottom drawer is shown being independent and free of the upper two. Actually, all three drawers may be reversably modified so as to be relatively shallow and independent, as illustrated by the bottom drawer, or any two or more can be ganged together and made into a relatively deep composite drawer, as illustrated by the top two drawers. For instance, in addition to the variations depicted, the bottom two drawers could be consolidated into one and the top drawer left independent, or all three drawers could be consolidated into one or all three could be left independent. The many variations possible when there are two, four or some other number of drawers in the stack will suggest themselves from the examples shown and just described.

Figure 2:
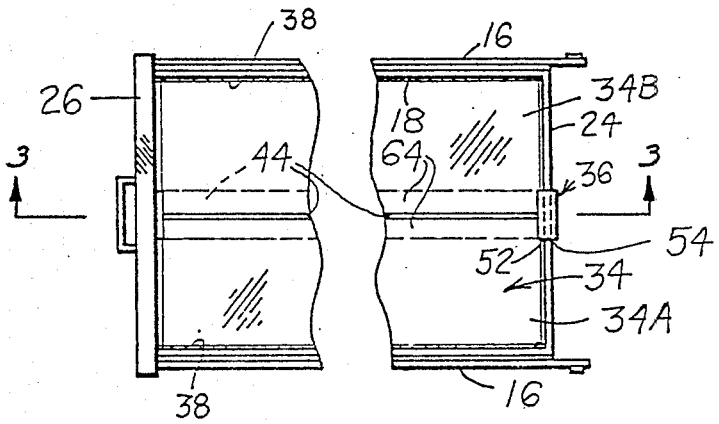
FIG. 2 is a fragmentary top plan view of one of the drawers after its modification in accordance with the principles of the invention.
Figure 3:
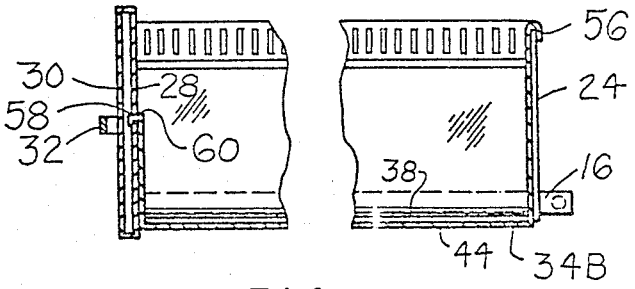
FIG. 3 is a fragmentary longitudinal sectional view of that drawer taken on line 3—3 of FIG. 2.
Figure 4:
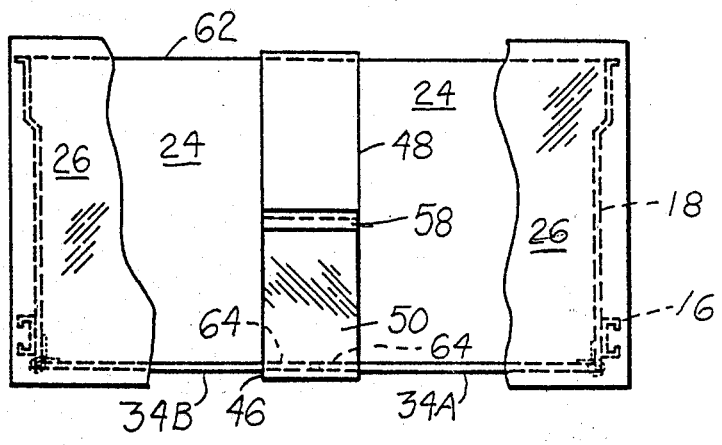
FIG. 4 is a front elevational view of that drawer with part of the drawer front broken away to expose interior details.

Just what has been done to unite the top two drawers 214 together shows best in FIG. 2, where 214T identifies the relatively upper, in this case the uppermost drawer and 214M identifies the relatively next lower, in this case the middle drawer.

First, while the drawer bottom 234 of lower drawer 214M remains in place with its edges 254 mounted in the rabbet 252, the drawer bottom 234 of the upper drawer has been removed.

(The way the drawer bottom 234 is removed is suggested in FIG. 1, i.e. it is slid relatively rearwards until its edges 254 are completely free of the rabbet groove 252. Although it looks in FIG. 10 as if there would be a need to slide the drawer bottom out through the back wall of the desk pedestal, in actuality the task is simple: the drawer is pulled out in the normal fashion, and completely slid out of the case, next the drawer bottom is slid out of the rabbet and finally the drawer, minus its bottom is slid back into the case.)

Then connector means are removably installed between the now-bottomless drawer 214T and the lower drawer 214M. In the preferred embodiment illustrated, the connecting means takes the form of a strap 256, which has an outwardly directed tang 258 that is received in the rabbet of the upper drawer and a depending flange 258 that is disposed flatwise against the upper, inside marginal edge portion of the lower drawer and removably secured thereto, e.g. by wood screws 260.

Just how much of the strap 256 needs to be provided depends on the relation of the two drawers it connects. For instance, if there is an interference fit of the gang 258 in the rabbet 252, then, one short segment of strap 256 may suffice, or one short segment for each side wall (i.e. two short segments), or two for one side wall, or two for each side wall. The rabbet 252 may be locally increased in height or otherwise locally modified in shape (not shown) in order to specifically interfit with the tang(s) 258. In such a case, the tang(s) need not fit tightly in the rabbet, since in this instance the relationship is one which permits tang movement in the width direction (indicated by arrow 262), but not in the depth direction (indicated by arrow 264).

Other arrangements can preclude a necessity for having each tang 258 fit tightly in the rabbet 252. For instance, if two of the strap segments are applied to the side walls on at least one side, they may be located, respectively, at the front and rear interior corners of drawers having those side walls, so that the front end of the front strap segment abuts the interior sides of the drawer fronts and the rear end of the rear strap segment abuts the interior sides of the drawer backs. Another possibility is to have one strap segment which entirely fills the rabbet, extending frontwards along the drawer sidewalls on one side, turning a front corner and extending along the front walls, turning another corner and extending along the side walls on the other side. A further possibility is to have one strap segment which entirely fills the rabbet on one side wall, so that the front end of that strap segment engages the interior of the drawer fronts and the rear end of that strap segment engages the interior of the drawer backs. A strap segment of equal length and extent could be applied to the respective other side walls of the two drawers. In any of the variations where at least one strap segment is secured to at least one set of upper and lower corresponding side walls, a like, similar, or even a different connector may be applied between the two drawer fronts and/or between the two drawer backs.

Although the strap segment depicted is shown having a tang received in the rabbet 252 as the sole means of connecting that strap segment with the upper drawer, other or additional removable or releasable securement means (not shown) such as wood screws, may be used to connect the strap segment 256 to the upper drawer.

The net effect of employing the structure shown in FIG. 10 is that so long as the connector means is mounted in place as shown, when either the top drawer or middle drawer is pulled-out or pushed-in the other will come and go with it, while the lower drawer remains independent, and the interior volumes of the top and middle drawers are consolidated into a single unobstructed volume having a combined height which extends upwards from the bottom 234 of the middle drawer to the upper edge of the top drawer.

Figure 11:
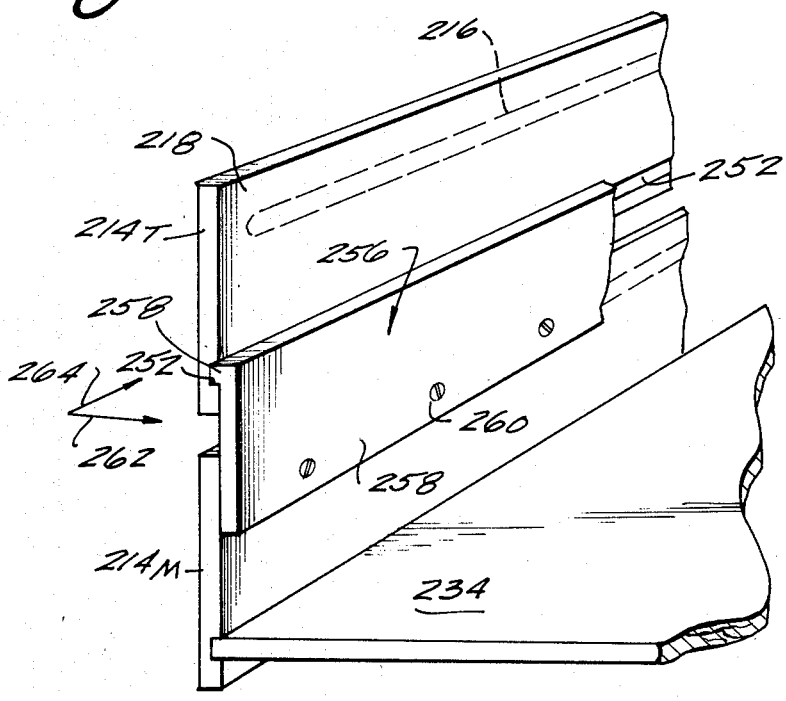
FIG. 11 is a larger scale fragmentary perspective view of a portion of the structure shown in FIG. 10.

While the construction shown in FIGS. 10 and 11 is conceived for use especially on wooden furniture, it is apparent that the same features and functions can be provided in substantially the same manner when the case and/or the drawers and/or the strap segment(s) are made of other materials, such as fabricated sheet metal, molded and/or fabricated synthetic plastics and the like.

Another preferred embodiment will now be explained with reference to FIGS. 12 and 13.

Here the drawers 314M and 314B are shown as if they are molded of synthetic plastics, e.g. of conventional composition and by conventional techniques, or as if fabricated and formed of sheet metal so that the walls are of double wall hollow construction having rounded corners. If fabricated, the side walls may be formed as an integral member having a seam at 380. The suspension roller or slide guide suspension means are provided in elongated recesses 316 molded or otherwise formed in the exteriors of the side walls 320.

The interiors of the front 326 and both side walls 318 of each drawer 314, near the lower edges are shown having a rabbet 352 in which a drawer bottom 324 may be slidably received from the rear. As with the embodiment shown in FIGS. 10 and 11, the rear wall of each drawer either extends downwardly only to the level of the upper extent of the rabbet, or else it is slotted comparably to the height and width of the drawer bottom 334.

As should be apparent, in FIG. 12, the drawer bottom 334M of the upper drawer 314M is being slid out and is shown partially removed, while the drawer bottom 334B of the lower drawer is shown remaining in place. In FIG. 13, removal of the drawer bottom 334B has been completed so that the rabbet 352 of the drawer 314M is empty, but the drawer bottom 334B remains in place mounted to the drawer 314B.

Each of the drawers 314 is provided with at least one internally threaded vertical conduit or opening means 382 at a respective standard location, so that when the two drawers are vertically in fully registered superposition, the threaded opening(s) 382 in the upper drawer is (or are) aligned with the corresponding threaded opening(s) 382 in the lower drawer. (In the instance depicted each drawer has three threaded openings 382, one in each side wall and one in the back wall. This arrangement is merely illustrative.)

Each threaded opening 382 is shown threadedly receiving a threaded stud 384 which is somewhat shorter than the respective drawer wall is tall. Each threaded stud 384 is shown provided with a wrenching fixture 386, e.g. a screwdriver receiving slot in one end, e.g. the upper end thereof. Accordingly, each stud 384 may be "parked" entirely within the threaded opening 382 (such as is the lower stud 384 shown in FIG. 13), or it may be threadedly advanced or retracted so that it becomes a securing bridge vertically between the two drawers by having its upper end threaded into the lower end of the opening means 382 in the upper drawer and its lower end threaded into the upper end of the opening means 382 in the lower drawer.

The drawers 314 may be slidingly mounted in a case such as a desk pedestal as described hereinabove with regard to the embodiment of FIGS. 10 and 11, and may be similarly reversibly converted between being a larger number of relatively shallow independent drawers and a smaller number of relatively taller composite drawers as should now be apparent.

Many variations on the specifics of the means for disconnectably gangingly connecting the upper and lower drawers together are contemplated. A modification is shown in FIG. 14 that is similar in most respects to what is shown in FIGS. 12 and 13. The difference is that in FIG. 14, the opening means 482 are provided only in the drawer fronts or in the side walls near the fronts. Each opening means 482 is smooth-walled and is divided by a transverse central web 486 into an upwardly open socket and a downwardly opening socket. In order to associate two vertically-stacked drawers 414 together, the drawer bottom 434 of the upper drawer is removed and a peg, dowel pin or the like 484 is slipped vertically between the drawers. As the drawers are brought together, the lower part of the pin 484 is slidingly received in the upwardly opening socket of the lower drawer and the upper part of the pin 484 is slidingly received in the downwardly opening socket of the upper drawer. (This may be accomplished either by pulling both of the drawers all the way out of the case, associating them together and sliding the composite back into the case, or by pulling both drawers out until the stops (not shown) of their side suspension mechanisms catch, then temporarily tilting the upper drawer upwards enough to slip the pin into place, and then sliding the composite drawer back into the case. This procedure may be reversed in order to make the drawers independent again.

It should now be apparent that the improvements in drawer associating constructions as described hereinabove, possess each of the attributes set forth in the specification under the heading "Summary of the Invention" hereinbefore. Because the constructions can be modified to some extent without departing from the principles thereof as they have been outlined and explained in this specification, the present invention should be understood as encompassing all such modifications as are within the spirit and scope of the following claims.

What is claimed is:

1. A drawer assembly, comprising:

a first, upper drawer member including two upstanding side walls, an upstanding front wall and an upstanding rear wall;

at least one of said wall of said first, upper drawer member including means for removably securing a floor thereto for said first, upper drawer member;

a second, lower drawer member including two upstanding side walls, an upstanding front wall and an upstanding rear wall;

said second, lower drawer member further including a floor;

said first, upper drawer member being in vertical juxtaposition with said second, lower drawer member; and said drawer assembly further including at least one securement member effectively releasably ganging at least one said wall of said first, upper drawer member to at least one said wall of said second, lower drawer member, so that pulling-out and pushing-in of either of said drawer members while said drawer members are so releasably ganged together will serve to pull out and push in both of said drawer members as a unit.

2. The drawer assembly of claim 1, wherein:

said means for removably securing a floor for said first, upper drawer member to at least one of said walls of that drawer member comprises:

generally rectangular floor means having opposed side marginal edge portions having securement means thereon, and a front edge marginal portion opposed to a rear edge marginal portion;

said at least one of said walls including at least both of said side walls, there being securement means on both said side walls removably securable with said securement means of said opposed side marginal edge portions.

3. The drawer assembly of claim 2, wherein:

the securement means on both said side walls are constituted by a rabbet in which said opposed side marginal portions of said floor means are slidably received when said floor means is assembled with said walls of said first, upper drawer member and said first, upper drawer member is not ganged to said second, lower drawer member.

4. The drawer assembly of claim 3, wherein:

the front wall of said first upper drawer member includes a rearwardly-opening rabbet, in which the front marginal edge portion of said floor means is slidably received when said floor means is assembled with said walls of said first, upper drawer member is not ganged to said second, lower drawer member.

5. The drawer assembly of any one of claims 1, 2, 3 or 4 in which:

said at least one securement member effectively releasably ganging at least one said wall of said first, upper drawer member to at least one said wall of said second, lower drawer member comprises a strap disposed interiorly of both drawer members, said strap bearing securement means for removably securing at least one said wall of said first, upper drawer member to a comparable at least one said wall of said second, lower drawer.

6. The drawer assembly of any one of claims 1, 2, 3 or 4 in which:

said at least one securement member effectively releasably ganging at least one said wall of said first, upper drawer member to at least one said wall of said second, lower drawer member comprises a strap disposed interiorly of both drawer members, said strap bearing securement means for removably securing at least one said wall of said first, upper drawer member to a comparable at least one said wall of said second, lower drawer;

further comprising tang means on said strap, removably interdigitated with said rabbet.

7. The drawer assembly of any one of claims 1, 2, 3 or 4 in which:

said at least one securement member effectively releasably ganging at least one said wall of said first, upper drawer member to at least one said wall of said second, lower drawer member comprises:

means defining a downwardly opening socket means in at least one of said walls of said first, upper drawer member;

means defining an upwardly opening socket means in a comparable at least one of said walls of said second, lower drawer member;

when the two said drawer members are aligned in vertical juxtaposition, each said downwardly opening socket being in vertical registry with a comparable one of said at least one upwardly opening socket to provide a respective at least one pair of sockets;

a pin means being received in at least one pair of sockets, so as to extend in both said sockets of that pair of sockets, thus physically bridging between said two drawer members.

8. The drawer assembly of claim 1, wherein:

said at least one securement member effectively releasably ganging at least one said wall of said first, upper drawer member to at least one said wall of said second, lower drawer member comprises:

means defining a downwardly opening socket means in at least one of said walls of said first, upper drawer member;

means defining an upwardly opening socket means in a comparable at least one of said walls of said second, lower drawer member;

when the two said drawer members are aligned in vertical juxtaposition, each said downwardly opening socket being in vertical registry with a comparable one of said at least one upwardly opening socket to provide a respective at least one pair of sockets;

a pin means being received in at least one pair of sockets, so as to extend in both said sockets of that pair of sockets, thus physically bridging between said two drawer members;

said pin means being threaded and at least one of said sockets in said pair of sockets being threaded, said pin means being threadedly received in that socket.

9. The drawer assembly of claim 1, wherein:

said securement member releasably gangs together with said at least one said wall of said first, upper drawer member, the comparable said at least one wall of said second, lower drawer member.

10. The drawer assembly of claim 9, wherein:

said at least one securement member comprises a panel means removably secured to a said side wall of said first, upper drawer member and depending into said second, lower drawer member in adjacency with the comparable at least one side wall of said second, lower drawer member.

11. A drawer assembly, comprising:

a drawer member of generally rectangular plan figure and including two upstanding side walls, an upstanding front wall, an upstanding rear wall and a floor;

a drawer wall upward extension unit of generally rectangular plan figure and including two upstanding side wall extenders, an upstanding front wall extender and an upstanding rear wall extender;

said drawer wall upward extension unit being juxtaposed upon said drawer member;

recess means in said drawer wall upward extension unit; and a securement member mounted to said drawer member and removably received in said recess means and releasably connecting the drawer wall upward extension unit to said drawer member.

12. The drawer assembly of claim 11, wherein:

said recess means is a rabbet.

13. A drawer assembly, comprising:

a drawer wall upward extension unit of generally rectangular plan figure and including two upstanding side wall extenders, an upstanding front wall extender and an upstanding rear wall extender;

means for juxtaposing said drawer wall upward extension unit upon a drawer; and a securement member mounted to said drawer wall upward extension unit and projecting downwards therefrom for locking with the subjacent drawer when said drawer wall upward extension unit is juxtaposed upon such a drawer;

said drawer wall upward extension unit having at least one wall thereof provided with means for removably securing a drawer floor thereto;

said securement member being mounted to said means for removably securing a drawer floor to said drawer wall upward extension unit;

said means for removably securing a drawer floor to said drawer wall upward extension unit comprising a rabbet in at least one wall of said drawer wall upward extension unit;

said securement member comprising a strap having a tang fitted into said rabbet; a flange depending below the tang; and fastening means on the flange for removably fastening the flange to the subjacent drawer when said drawer wall upward extension unit is juxtapositioned on such a drawer.

14. The drawer assembly of claim 13, wherein:

said drawer wall upward extension unit front wall comprises a drawer front having a drawer pull on the exterior thereof.

15. A drawer assembly, comprising:

two drawers in vertically stacked relation, the upper one of which is lacking a drawer bottom in normal, article-supporting relation, so that there is open communication down through said upper drawer with the respective lower drawer; and means received in a recess in the upper drawer and secured to the lower drawer and thereby ganging said two drawers together so that pulling-out and pushing-in either one of said drawers pulls-out and pushes in both of said drawers;

said ganging means being mounted to said upper drawering in a rabbet where a drawer bottom normally would be mounted to said upper drawer.

16. The drawer assembly of claim 15, wherein:

said ganging means depends from said upper drawer into said lower drawer for ganging said two drawers together.

* * * * *